US007851997B2

(12) United States Patent
Ito et al.

(10) Patent No.: US 7,851,997 B2
(45) Date of Patent: Dec. 14, 2010

(54) LIGHT EMITTING ELEMENT AND LIGHT EMITTING DEVICE

(75) Inventors: Shunichi Ito, Kanagawa (JP); Hisao Ikeda, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 409 days.

(21) Appl. No.: 11/754,495

(22) Filed: May 29, 2007

(65) Prior Publication Data

US 2007/0278946 A1 Dec. 6, 2007

(30) Foreign Application Priority Data

Jun. 2, 2006 (JP) ..... 2006-155387

(51) Int. Cl.
*H05B 51/00* (2006.01)

(52) U.S. Cl. ..... 313/506

(58) Field of Classification Search ..... 313/506, 313/504

See application file for complete search history.

(56) References Cited

U.S. PATENT DOCUMENTS

| | | | |
|---|---|---|---|
| 5,003,221 | A | 3/1991 | Shimizu |
| 5,508,532 | A | 4/1996 | Teramoto |
| 7,560,749 | B2 | 7/2009 | Sakata et al. |
| 7,622,744 | B2 | 11/2009 | Sakata et al. |
| 2004/0160171 | A1 | 8/2004 | Takahashi |
| 2007/0176535 | A1 | 8/2007 | Sakata |
| 2007/0190235 | A1 | 8/2007 | Yamazaki et al. |
| 2007/0205410 | A1 | 9/2007 | Ikeda et al. |
| 2007/0205416 | A1 | 9/2007 | Sakata et al. |
| 2007/0205417 | A1 | 9/2007 | Ohara et al. |
| 2007/0205428 | A1 | 9/2007 | Katayama et al. |
| 2007/0221888 | A1 | 9/2007 | Sakata |
| 2007/0281574 | A1 | 12/2007 | Ohara et al. |

FOREIGN PATENT DOCUMENTS

| | | |
|---|---|---|
| EP | 0 421 494 | 4/1991 |
| GB | 2 286 081 | 8/1995 |
| JP | 07-211458 | 8/1995 |
| JP | 2002-043054 | 2/2002 |
| JP | 2003-077677 | 3/2003 |

OTHER PUBLICATIONS

European Search Report (Application No. 07010259.5), dated Oct. 1, 2007, 9 pages.

*Primary Examiner*—Toan Ton
*Assistant Examiner*—Hana S Featherly
(74) *Attorney, Agent, or Firm*—Fish & Richardson P.C.

(57) ABSTRACT

It is an object of the present invention to provide a high-performance and highly reliable light emitting element which has high light emission luminance and luminous efficiency and good adhesiveness inside the element. A feature of the present invention is that the refractive index, internal stress, and dielectric constant are made to change continuously in an insulating layer included in a light emitting element. Since properties of the film are changed continuously in a single layer, this insulating layer has gradations of property values of the film (refractive index, internal stress, dielectric constant, and the like) in the film, and has no interface which is generated in a case of a stacked structure.

18 Claims, 11 Drawing Sheets

LIGHT EMITTING ELEMENT AND LIGHT EMITTING DEVICE

BACKGROUND OF THE INVENTION

1. Field of the Invention

The present invention relates to manufacture of electroluminescent elements using an inorganic material. In addition, the present invention relates to light emitting devices and electronic devices using the electroluminescent elements.

2. Description of the Related Art

In recent years, liquid crystal display devices and electroluminescent display devices which are formed by integrating thin film transistors (hereinafter also referred to as TFTs) over a glass substrate have been developed. As for any of these display devices, thin film transistors are formed over a glass substrate using a thin film formation technique, and display elements such as liquid crystal elements or light emitting elements (electroluminescent (hereinafter also referred to as EL) elements) are formed over various circuits including the thin film transistors, thereby functioning as display devices.

Light emitting elements utilizing electroluminescence can be classified according to whether a light emitting material is an organic compound or an inorganic compound. In general, the former are referred to as organic EL elements, and the latter are referred to as inorganic EL elements.

The inorganic EL elements are classified according to their element structures into dispersion-type inorganic EL elements and thin-film inorganic EL elements. Since the inorganic EL elements obtain EL light emission by application of an AC voltage, an insulating layer to be a dielectric is necessary. In addition to a high dielectric constant, a high withstand voltage and the like are required for the insulating layer, and there is a method in which the insulating layer is formed with a stacked structure in order to meet the characteristic requirements (for example, refer to Reference 1: Japanese Published Patent Application No. 2003-77677). Furthermore, the density of a film is increased for increasing the withstand voltage, the internal stress of the film is also increased and peeling at an interface may be generated. Therefore, there is a method in which a film with a low stress is interposed as a buffer layer in order to relieve the internal stress, in forming a stacked structure.

SUMMARY OF THE INVENTION

However, when an insulating layer has a stacked structure including a buffer layer and an insulating layer, the refractive index of a film that is stacked as the buffer layer and the refractive index of the insulating layer may be different from each other. In such a case, there occurs a problem in that reflection of light emitted from a light emitting layer is generated at an interface in the stacked insulating layer, and light emission luminance and luminous efficiency are lowered. Accordingly, further improvements in light emission luminance and luminous efficiency are desired.

In view of the above problems, it is an object of the present invention to provide a high-performance and highly reliable light emitting element which has high light emission luminance and luminous efficiency and good adhesiveness inside the element. Furthermore, it is another object of the present invention to provide a high-performance and highly reliable light emitting device having such a light emitting element.

One feature of the present invention is that the refractive index, internal stress, and dielectric constant are made to change continuously in an insulating layer included in a light emitting element. Since properties of the film are changed continuously in a single layer, this insulating layer has gradations of property values of the film (refractive index, internal stress, dielectric constant, and the like) in the film, and has no interface which is generated in a case of a stacked structure. It is to be noted that, in the present specification, "change continuously" means that property values of the film (refractive index, internal stress, dielectric constant, and the like) increase or decrease monotonically in a film thickness direction.

In an insulating layer provided in a light emitting element, when films with different refractive indexes are stacked for controlling the refractive index of the insulating layer, reflection of light emitted from a light emitting layer is generated at an interface of the stacked films. Such reflection of light decreases efficiency of extracting light to external.

In the insulating layer of the present invention, the refractive index of the insulating layer is controlled by increasing or decreasing the refractive index monotonically without using a stacked structure and without having an interface in a single layer. Accordingly, loss in extraction of light due to reflection at the interface can be reduced, and light emission luminance and luminous efficiency of a light emitting element are improved.

Furthermore, in the insulating layer of the present invention, the internal stress is increased or decreased monotonically in a single layer; therefore, the stress is eased and peeling due to difference in stress at an interface between the insulating layer and a light emitting layer or at an interface between the insulating layer and an electrode layer can be prevented.

Furthermore, in the insulating layer, the dielectric constant is increased or decreased monotonically; therefore, the dielectric constant improves in comparison with a case where an insulating layer has a stacked structure.

Accordingly, the insulating layer of the present invention can ease the internal stress between layers included in the light emitting element, improve the light emission luminance, and improve the dielectric constant.

One mode of a light emitting element of the present invention includes an insulating layer over a first electrode layer, an electroluminescent layer comprising an inorganic compound over the insulating layer, and a second electrode layer over the electroluminescent layer; and a refractive index of the insulating layer increases from the first electrode layer side toward the electroluminescent layer side.

In the above structure, the insulating layer is provided as a single layer between the electrode layer and the electroluminescent layer, and stacked so as to be in contact with the electrode layer and the electroluminescent layer. A dielectric constant of the insulating layer increases from the first electrode layer side toward the electroluminescent layer side. An internal stress of the insulating layer increases from the first electrode layer side toward the electroluminescent layer side.

Another mode of a light emitting element of the present invention includes an insulating layer over a first electrode layer, an electroluminescent layer comprising an inorganic compound over the insulating layer, and a second electrode layer over the electroluminescent layer; and a refractive index of the insulating layer increases from the first electrode layer side toward the electroluminescent layer side, and further a second insulating film interposed between the second electrode layer and the electroluminescent layer; and a refractive index of the second insulating layer increases from the second electrode layer side toward the electroluminescent layer side.

In the above structure, the insulating layer is provided as a single layer between the first electrode layer and the electroluminescent layer, and stacked so as to be in contact with the first electrode layer and the electroluminescent layer. A dielectric constant of the insulating layer increases from the first electrode layer side toward the electroluminescent layer side. An internal stress of the insulating layer increases from the first electrode layer side toward the electroluminescent layer side. The second insulating layer is provided as a single layer between the second electrode layer and the electroluminescent layer, and stacked so as to be in contact with the second electrode layer and the electroluminescent layer. A dielectric constant of the second insulating layer increases from the second electrode layer side toward the electroluminescent layer side. An internal stress of the second insulating layer increases from the second electrode layer side toward the electroluminescent layer side.

Another mode of a light emitting element of the present invention includes an insulating layer comprising silicon, oxygen and nitrogen, over a first electrode layer, an electroluminescent layer comprising an inorganic compound over the insulating layer, and a second electrode layer over the electroluminescent layer; and a concentration of oxygen contained in the insulating layer decreases from the first electrode layer side toward the electroluminescent layer side, and a concentration of nitrogen contained in the insulating layer increases from the first electrode layer side toward the electroluminescent layer side. In the above structure, the insulating layer is provided as a single layer between the electrode layer and the electroluminescent layer, and stacked so as to be in contact with the electrode layer and the electroluminescent layer. A refractive index of the insulating layer increases from the first electrode layer side toward the electroluminescent layer side. A dielectric constant of the insulating layer increases from the first electrode layer side toward the electroluminescent layer side. An internal stress of the insulating layer increases from the first electrode layer side toward the electroluminescent layer side.

Another mode of a light emitting element of the present invention includes an insulating layer comprising silicon, oxygen and nitrogen, over a first electrode layer, an electroluminescent layer comprising an inorganic compound over the insulating layer, and a second electrode layer over the electroluminescent layer; and a concentration of oxygen contained in the insulating layer decreases from the first electrode layer side toward the electroluminescent layer side, and a concentration of nitrogen contained in the insulating layer increases from the first electrode layer side toward the electroluminescent layer side; and further a second insulating film comprising silicon, oxygen and nitrogen, interposed between the second electrode layer and the electroluminescent layer; and a concentration of oxygen contained in the second insulating layer decreases from the second electrode layer side toward the electroluminescent layer side, and a concentration of nitrogen contained in the second insulating layer increases from the second electrode layer side toward the electroluminescent layer side. In the above structure, the insulating layer is provided as a single layer between the first electrode layer and the electroluminescent layer, and stacked so as to be in contact with the first electrode layer and the electroluminescent layer. A refractive index of the insulating layer increases from the first electrode layer side toward the electroluminescent layer side. A dielectric constant of the insulating layer increases from the first electrode layer side toward the electroluminescent layer side. An internal stress of the insulating layer increases from the first electrode layer side toward the electroluminescent layer side. The second insulating layer is provided as a single layer between the second electrode layer and the electroluminescent layer, and stacked so as to be in contact with the second electrode layer and the electroluminescent layer. A refractive index of the second insulating layer increases from the second electrode layer side toward the electroluminescent layer side. A dielectric constant of the second insulating layer increases from the second electrode layer side toward the electroluminescent layer side. An internal stress of the second insulating layer increases from the second electrode layer side toward the electroluminescent layer side.

In the above structures, the refractive index, the dielectric constant and the internal stress of the insulating layer increase monotonically from the first electrode layer side toward the electroluminescent layer side. The refractive index, the dielectric constant and the internal stress of the second insulating layer increase monotonically from the second electrode layer side toward the electroluminescent layer side. The concentration of oxygen contained in the insulating layer decrease monotonically from the first electrode layer side toward the electroluminescent layer side, and the concentration of nitrogen contained in the insulating layer increase monotonically from the first electrode layer side toward the electroluminescent layer side. The concentration of oxygen contained in the second insulating layer decrease monotonically from the second electrode layer side toward the electroluminescent layer side, and the concentration of nitrogen contained in the second insulating layer increase monotonically from the second electrode layer side toward the electroluminescent layer side. It is preferable that the film thickness of the insulating layer be greater than or equal to 50 nm and less than or equal to 1000 nm.

In an insulating layer included in a light emitting element of the present invention, there is no interface in a single layer and the refractive index is changed continuously; therefore, loss in light extraction efficiency due to reflection can be reduced. In addition, since the internal stress is changed continuously in the single layer, the stress can be eased and peeling at an interface can be prevented. In addition, reduction in film thickness of a film with a low stress to be a stress relaxation layer is possible, and thus reduction in film thickness of the element as a whole is possible. Furthermore, since the dielectric constant is changed continuously, the dielectric constant improves in comparison with a case where the insulating layer is structured by stacking layers. Accordingly, high light emission luminance and luminous efficiency can be obtained, and a light emitting element with high performance, high image quality, and high reliability can be provided.

Therefore, a display device including a light emitting element using the present invention can be a display device with high performance, high image quality, and high reliability.

Furthermore, the insulating layer of the present invention, in which property values of the film change continuously, can be formed by one-time film formation. Consequently, simplification of the process can be achieved and productivity is also improved, in comparison with a case of forming an insulating layer with a stacked structure.

By the present invention, a light emitting element (hereinafter also referred to as an EL element) in which a layer producing light emission called electroluminescence is interposed between electrodes, and a display device including the light emitting element can be manufactured. Display devices for which the present invention can be used include a light emitting display device (also simply referred to as a light emitting device) in which a light emitting element and a thin film transistor (hereinafter also referred to as TFT) are connected and the like. EL elements include an element which at least contains a material from which electroluminescence is obtained and emits light when a current is applied.

BRIEF DESCRIPTION OF THE DRAWINGS

In the accompanying drawings.

DETAILED DESCRIPTION OF THE INVENTION

Figure 1A:
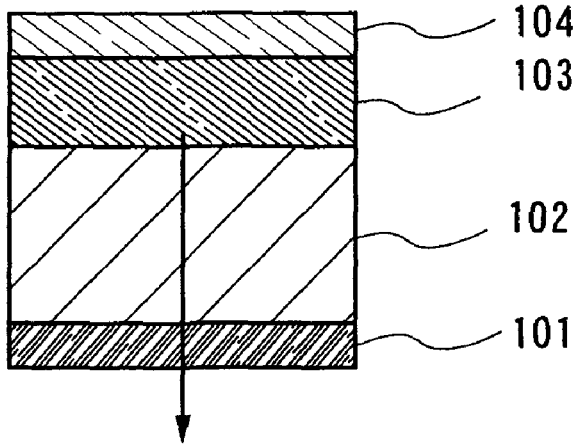
FIGS. 1A to 1C are views of light emitting elements of the present invention.

Embodiment Modes of the present invention will be explained below with reference to the accompanied drawings. However, the present invention can be carried out in various modes and it is to be easily understood by those skilled in the art that the modes and details can be changed in various ways without departing from the spirit and scope of the present invention. Therefore, the present invention should not be interpreted as being limited to the description of the embodiment modes. In all the drawings used for describing the embodiment modes, the same portions or portions having similar functions may be denoted by the same reference numerals, and the repeated description will be omitted.

Embodiment Mode 1

A light emitting element and a manufacturing method of the light emitting element of this embodiment mode will be described in detail with reference to FIGS. 1A to 1C. In this embodiment mode, an insulating layer is provided between only one of a pair of electrodes sandwiching a light emitting layer and the light emitting layer. Further, although a thin-film light emission will be described in this embodiment mode, the present invention can be similarly applied to dispersion-type light emission.

Inorganic EL elements can be classified according to their element structures into dispersion-type inorganic EL elements and thin-film inorganic EL elements. These inorganic EL elements, which obtain EL light emission by application of an AC voltage, require insulating layers to be dielectrics. A high withstand voltage is required for the insulating layer; however, when the density of the film is increased so as to increase the withstand voltage, the internal stress of the film is also increased and peeling at an interface may be generated. Therefore, there is a method in which a film with a low stress is interposed as a buffer layer in order to ease the internal stress, in forming a stacked structure.

Figure 1B:
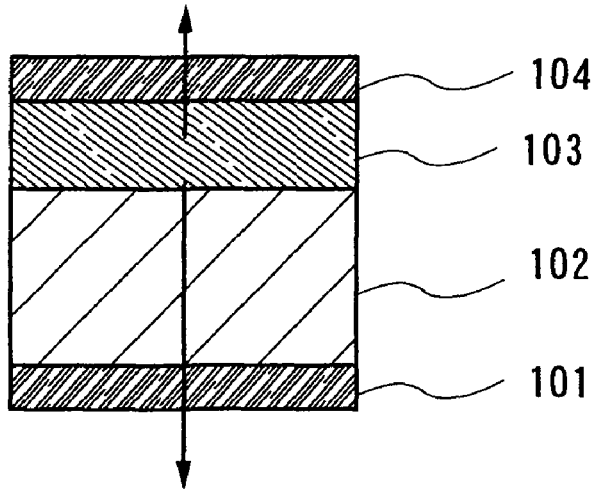
Figure 1C:
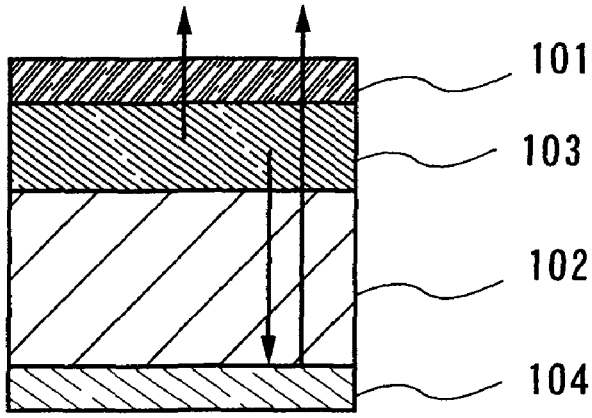

An example of a thin-film inorganic EL element which can be used as a light emitting element is shown in FIGS. 1A to 1C.

In FIGS. 1A and 1B, a light emitting element includes a first electrode layer 101, an insulating layer 102, an electroluminescent layer 103, and a second electrode layer 104, and these layers are stacked in this order. The insulating layer 102 is provided between the first electrode layer 101 and the electroluminescent layer 103 so as to be in contact with the first electrode layer 101 and the electroluminescent layer 103. When the first electrode layer 101 is an electrode film having a light-transmitting property and the second electrode layer 104 is a reflective electrode film, light is extracted from the first electrode layer 101 side, as shown FIG. 1A, which is a single-side emission type. When both the first electrode layer 101 and the second electrode layer 104 are electrode films having a light-transmitting property, light is extracted from the first electrode layer 101 side and the second electrode layer 104 side both, as shown in FIG. 1B, which is a dual emission type.

The insulating layer 102 shown in FIGS. 1A and 1B includes silicon nitride (SiN) with a high refractive index on the electroluminescent layer 103 side and silicon oxynitride (SiON) or silicon oxide ($SiO_2$) with a low refractive index on the first electrode layer 101 side. Since properties of the film are changed continuously in a single layer, this insulating layer has gradations of property values of the film (refractive index, internal stress, dielectric constant, and the like) in the film, and has no interface which is generated in a case of a stacked structure. In this insulating layer, the refractive index is changed continuously and there is no reflection at an interface; therefore, light extraction efficiency is improved, compared to a case where a film with a high refractive index and a film with a low refractive index are stacked. In the present specification, a refractive index "continuously changes" means that a refractive index increases or decreases monotonically in a film thickness direction of an insulating film. For example, in FIGS. 1A and 1B, the refractive index of the insulating layer 102 increases monotonically from the first electrode layer 101 side toward the electroluminescent layer 103 side.

Furthermore, the insulating layer 102 includes silicon nitride (SiN) with a high dielectric constant on the electroluminescent layer 103 side and silicon oxynitride (SiON) or silicon oxide ($SiO_2$) with a low dielectric constant on the first electrode layer 101 side. Since the dielectric constant is changed continuously in the insulating layer 102 without an interface, the dielectric constant improves, compared to a case where the insulating layer is structured by stacking layers.

Furthermore, since silicon oxynitride or silicon oxide with a low stress is provided on the first electrode layer 101 side, peeling at an interface with the first electrode layer 101 can be prevented, which improves reliability. In addition, it is preferable that silicon nitride whose withstand voltage is high be in contact with the electroluminescent layer 103. In addition, it is preferable that silicon oxynitride or silicon oxide which forms a film with a low stress be in contact with the first electrode layer 101 and that the refractive index of the silicon oxynitride or silicon oxide be equal or close to the refractive index of the first electrode layer 101.

In FIG. 1C, a light emitting element includes a first electrode layer 101, an electroluminescent layer 103, an insulating layer 102, and a second electrode layer 104, and these layers are stacked in this order. The insulating layer 102 is provided between the second electrode layer 104 and the electroluminescent layer 103 so as to be in contact with the second electrode layer 104 and the electroluminescent layer 103. Furthermore, the first electrode layer 101 is an electrode having a light-transmitting property, and the second electrode layer 104 is a reflective electrode, which means that this light emitting element is of a single-side emission type, extracting light from the first electrode layer 101 side.

The insulating layer 102 in FIG. 1C includes silicon nitride with a high withstand voltage on the electroluminescent layer 103 side and silicon oxynitride or silicon oxide which forms a film with a low stress on the second electrode layer 104 side, and the refractive index is changed continuously in the insulating layer 102 without an interface. Light that is emitted from the electroluminescent layer 103 to the second electrode layer 104 side passes through the insulating layer 102, is reflected by the second electrode layer 104, passes through the insulating layer 102 again, and is transmitted through the first electrode layer 101. Therefore, it is preferable that the insulating layer 102 between the electroluminescent layer 103 and the second electrode layer 104 have no interface and the refractive index change continuously therein. In addition, by forming the insulating layer 102 so as to include silicon oxynitride or silicon oxide that forms a film with a low stress on the second electrode layer 104 side, peeling at an interface with the second electrode layer 104 can be prevented and the reliability is improved.

A material for the insulating layer 102 in FIGS. 1A to 1C is not particularly limited; however, a material with a high withstand voltage and dense film quality which is not easily peeled is preferable. In addition, a material with a high dielectric constant is preferable. For example, several kinds of materials selected from the following can be used: silicon nitride (SiN), silicon oxide ($SiO_2$), silicon oxynitride (SiON), yttrium oxide ($Y_2O_3$), titanium oxide ($TiO_2$), aluminum oxide ($Al_2O_3$), hafnium oxide ($HfO_2$), tantalum oxide ($Ta_2O_5$), barium titanate ($BaTiO_3$), strontium titanate ($SrTiO_3$), lead titanate ($PbTiO_3$), silicon nitride ($Si_3N_4$), zirconium oxide ($ZrO_2$), and the like. An insulating layer using these materials can be formed by sputtering, evaporation, CVD, or the like.

Furthermore, the insulating layer may be formed by dispersing particles of these insulating materials in a binder. A binder material may be formed using a material and a method similar to those of a binder contained in the electroluminescent layer. The film thickness of the insulating layer is not particularly limited, but preferably in a range of 10 to 1000 nm.

A light emitting material that can be used in the present invention includes of a base material and an impurity element to be a luminescent center. By changing the impurity element to be contained, light emission with various colors can be obtained. As a manufacturing method of a light emitting material, various methods such as a solid phase method and a liquid phase method (a coprecipitation method, for example) can be used. In addition, a method employing a pyrolytic reaction of a precursor, a spray pyrolysis method, a double decomposition method, a reverse micelle method, or a method in which one or more of the above methods and high-temperature baking are combined can be used. Alternatively, a liquid phase method such as a freeze-drying method can be used.

In the solid phase method, a base material and an impurity element or a compound containing an impurity element are weighed, mixed in a mortar, and then heated and baked in an electric furnace so as to be reacted, whereby the impurity element is contained in the base material. The baking temperature is preferably 700 to 1500° C. This is because if the temperature is much lower than 700° C., the solid phase reaction will not progress, while if the temperature is much higher than 1500° C., the base material will decompose. The mixture in powder form may be baked; however, it is preferable to bake the mixture in pellet form. Although the solid phase method requires baking at a relatively high temperature, it is a simple method, and therefore gives high productivity and is suitable for mass production.

In the liquid phase method (a coprecipitation method, for example), a base material or a compound containing a base material, and an impurity element or a compound containing an impurity element are reacted with each other in a solution, dried, and then baked. By the liquid phase method is used, the impurity element is uniformly distributed in the base material, the particles each have a small diameter, and the reaction can progress even at a low baking temperature.

As a base material for the light emitting material, a sulfide, an oxide, or a nitride can be used. As the sulfide, for example, zinc sulfide (ZnS), cadmium sulfide (CdS), calcium sulfide (CaS), yttrium sulfide ($Y_2S_3$), gallium sulfide ($Ga_2S_3$), strontium sulfide (SrS), barium sulfide (BaS), or the like can be used. As the oxide, for example, zinc oxide (ZnO), yttrium oxide ($Y_2O_3$), or the like can be used. As the nitride, for example, aluminum nitride (AlN), gallium nitride (GaN), indium nitride (InN), or the like can be used. In addition, zinc selenide (ZnSe), zinc telluride (ZnTe), or the like can also be used. A ternary mixed crystal such as calcium-gallium sulfide ($CaGa_2S_4$), strontium-gallium sulfide ($SrGa_2S_4$), or barium-gallium sulfide ($BaGa_2S_4$) may also be used.

As a luminescent center of localized emission, manganese (Mn), copper (Cu), samarium (Sm), terbium (Th), erbium (Er), thulium, (Tm), europium (Eu), cerium (Ce), praseodymium (Pr), or the like can be used. It is to be noted that halogen such as fluorine (F) or chlorine (Cl) may be added as charge compensation.

On the other hand, as a luminescent center of donor-acceptor recombination emission, a light emitting material containing a first impurity element forming a donor level and a second impurity element forming an acceptor level can be used. As the first impurity element, for example, fluorine (F), chlorine (Cl), aluminum (Al), or the like can be used. As the second impurity element, for example, copper (Cu), silver (Ag), or the like can be used.

In the case where a light emitting material for donor-acceptor recombination emission is synthesized by a solid phase method, a base material, the first impurity element or a compound containing the first impurity element, and the second impurity element or a compound containing the second impurity element are weighed, mixed in a motar, and then heated and baked in an electric furnace. As the base material, the above-described base material can be used. As the first impurity element, for example, fluorine (F), chlorine (Cl), or the like can be used, and as the compound containing the first impurity element, for example, aluminum sulfide ($Al_2S_3$) or the like can be used. As the second impurity element, for example, copper (Cu), silver (Ag), or the like can be used, and as the compound containing the second impurity element, copper sulfide ($Cu_2S$), silver sulfide ($Ag_2S$), or the like can be used. The baking temperature is preferably 700 to 1500° C. This is because if the temperature is much lower than 700° C., the solid phase reaction will not progress, while if the temperature is much higher than 1500° C., the base material will decompose. The mixture in powdered form may be baked; however, it is preferable to bake the mixture in pellet form.

As an impurity element in the case where solid phase reaction is used, a compound including the first impurity element and the second impurity element may be used. In this case, the impurity element is easily diffused in the base material and solid phase reaction easily progresses; therefore, a light emitting material in which the impurity element is uniformly distributed can be obtained. Furthermore, since an unnecessary impurity element does not enter the base material, a light emitting material with high purity can be obtained. As the compound including the first impurity element and the second impurity element, for example, copper chloride (CuCl), silver chloride (AgCl), and the like can be used.

The concentration of the impurity element may be 0.01 to 10 atom % with respect to the base material, and preferably in a range of 0.05 to 5 atom %.

In the case of a thin-film inorganic EL element, an electroluminescent layer is a layer containing the above-described light emitting material, and can be formed by using a vacuum evaporation method such as a resistance heating evaporation method or an electron beam (EB) evaporation method; a physical vapor deposition (PVD) method such as a sputtering method; a chemical vapor deposition (CVD) method such as a metal organic CVD method or a low-pressure hydride transport CVD method; an atomic layer epitaxy (ALE) method; or the like.

For the electrode layers (the first electrode layer and the second electrode layer) sandwiching the light emitting layer, a metal, an alloy, a conductive compound, a mixture thereof, or the like can be used. Specifically, an example thereof is indium tin oxide (ITO), indium tin oxide containing silicon or silicon oxide, indium zinc oxide (IZO), indium oxide containing tungsten oxide and zinc oxide (IWZO), or the like. These conductive metal oxide films are generally formed by sputtering. For example, indium zinc oxide (IZO) can be formed by sputtering using a target in which zinc oxide of 1 to 20 wt % is added to indium oxide. Indium oxide containing tungsten oxide and zinc oxide (IWZO) can be formed by sputtering using a target containing tungsten oxide of 1 to 5 wt % and zinc oxide of 0.5 to 1.5 wt % with respect to indium oxide. Alternatively, aluminum (Al), silver (Ag), gold (Au), platinum (Pt), nickel (Ni), tungsten (W), chromium (Cr), molybdenum (Mo), iron (Fe), cobalt (Co), copper (Cu), palladium (Pd), a nitride of metal materials (titanium nitride: TiN, for example), or the like can be used. When the first electrode layer or the second electrode layer is formed as an electrode layer having a light-transmitting property, a film of a material with low visible light transmittance can also be used for a light-transmitting electrode when formed with a thickness of approximately 1 to 50 nm, and preferably, 5 to 20 nm. The electrode can also be formed by vacuum evaporation, CVD, or a sol-gel method other than sputtering. Since light is extracted to external through the electrode layer, at least one of the pair of electrodes (the first electrode layer and the second electrode layer) or each of them needs to be formed of a material having a light-transmitting property.

As described above, light that is emitted from a light emitting layer is extracted, penetrating through an insulating layer in a light emitting element. An insulating layer included in a light emitting element of the present invention does not have an interface in the layer and is a film in which the refractive index and the dielectric constant are changed continuously; therefore, light extraction efficiency is high. In addition, since the internal stress therein is also changed continuously, the insulating layer has good adhesiveness with a light emitting layer and an electrode layer to be stacked. Specifically, the refractive index and dielectric constant, or the internal stress of the insulating layer increases monotonically from an electrode side toward an electroluminescent layer side. Accordingly, a highly reliable light emitting element with high luminous efficiency and high light emission luminance can be obtained. With such a light emitting element, a highly reliable and high-performance light emitting device can be manufactured.

Although the structure of the insulating layer is to include silicon nitride on the electroluminescent layer side and silicon oxynitride or silicon oxide on the first or second electrode side in this embodiment mode, implementation of the present invention is not limited to this structure, and it is acceptable as long as at least one of the refractive index, internal stress, or dielectric constant therein increases monotonically from an electrode side toward an electroluminescent layer side.

Hereinafter, a model case in which an insulating layer of a light emitting element has a stacked structure and the refractive index or dielectric constant therein is changed in a film thickness direction will be described as an example.

Figure 4A:
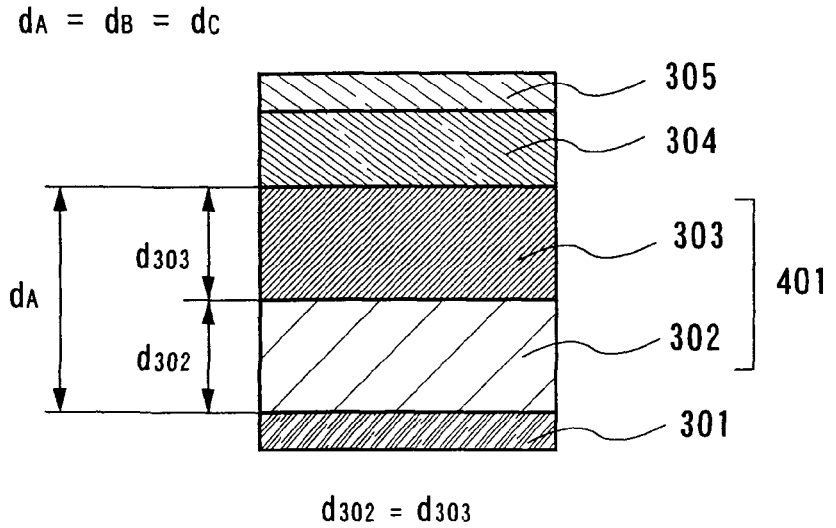
FIGS. 4A to 4C are views of light emitting elements of the present invention.
Figure 4B:
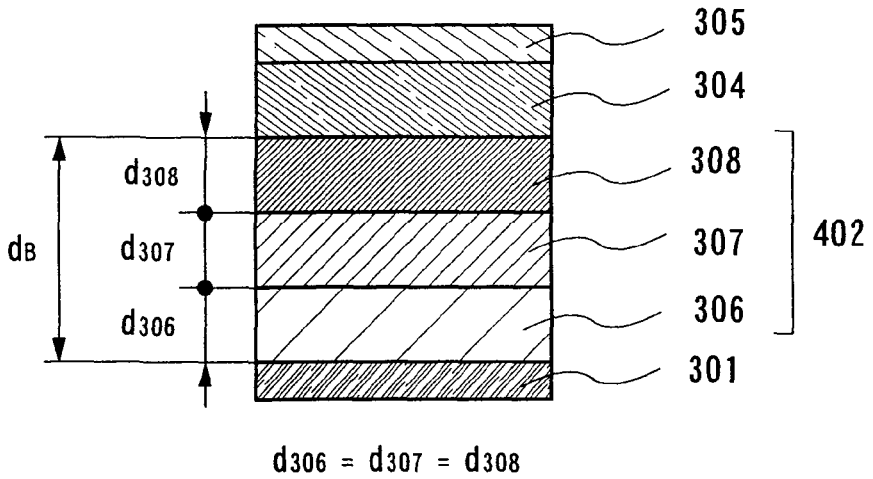
Figure 4C:
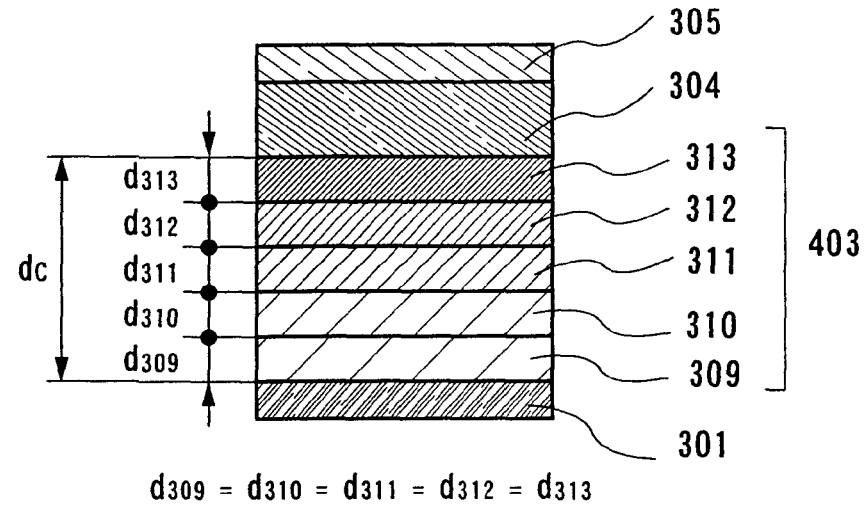

FIGS. 4A to 4C each show a structure in which an insulating layer included in a light emitting element is a multilayer stacked film. In FIGS. 4A to 4C, the refractive index (n) of the insulating layer is set as follows: the first electrode layer side, n=2.0; and the electroluminescent layer side, n=1.6.

In FIG. 4A, in a light emitting element, a first electrode layer 301, an insulating layer 401, an electroluminescent layer 304, and a second electrode layer 305 are stacked in this order. In addition, the insulating layer 401 is an insulating layer with a two-layer stacked structure including a first insulating layer 302 and a second insulating layer 303.

The refractive index $n_{302}$ of the insulating layer 302 and the refractive index $n_{303}$ of the insulating layer 303 are set to 1.6 and 2.0, respectively. At this time, the transmittance T is, $T=4\times n_{302}\times n_{303}/(n_{302}+n_{303})^2=0.9877$.

In FIG. 4B, in a light emitting element, a first electrode layer 301, an insulating layer 402, an electroluminescent layer 304, and a second electrode layer 305 are stacked in this order. In addition, the insulating layer 402 is an insulating layer with a three-layer stacked structure including a first insulating layer 306, a second insulating layer 307, and a third insulating layer 308. The refractive index $n_{306}$ of the insulating layer 306, the refractive index $n_{307}$ of the insulating layer 307, and the refractive index $n_{308}$ of the insulating layer 308 are set to 1.6, 1.8, and 1.6, respectively. At this time, the transmittance T is, T=0.9938.

In FIG. 4C, in a light emitting element, a first electrode layer 301, an insulating layer 403, an electroluminescent layer 304, and a second electrode layer 305 are stacked in this order. In addition, the insulating layer 403 is an insulating layer with a five-layer stacked structure including a first insulating layer 309, a second insulating layer 310, a third insulating layer 311, a fourth insulating layer 312, and a fifth insulating layer 313. The refractive index $n_{309}$ of the insulating layer 309, the refractive index $n_{310}$ of the insulating layer 310, the refractive index $n_{311}$ of the insulating layer 311, the refractive index $n_{312}$ of the insulating layer 312, and the refractive index $n_{313}$ of the insulating layer 313 are set to 1.6, 1.7, 1.8, 1.9, and 2.0, respectively. At this time, the transmittance T is, T=0.9962.

Furthermore, in FIGS. 4A to 4C, the dielectric constant (∈) of the insulating layer is set as follows: the first electrode layer side, ∈=4; and the electroluminescent layer side, ∈=8. In addition, here, the film thicknesses of the insulating layers in FIGS. 4A to 4C have the following relation: $d_A=d_B=d_C$. In addition, the film thicknesses of insulating layers included in the insulating layers 401 to 403 have the following relations: $d_{302}=d_{303}$, $d_{306}=d_{307}=d_{308}$, and $d_{309}=d_{310}=d_{311}=d_{312}=d_{313}$.

In FIG. 4A, the insulating layer 401 is an insulating layer with a two-layer stacked structure, and the dielectric constant $\in_{302}$ of the insulating layer 302 and the dielectric constant $\in_{303}$ of the insulating layer 303 are set to 4 and 8, respectively. At this time, the dielectric constant e of the insulating layer 401 is, $\in=2\times\in_{302}\times\in_{303}/(\in_{302}+\in_{303})=5.333$.

In FIG. 4B, the insulating layer 402 is an insulating layer with a three-layer stacked structure, and the dielectric constant $\in_{306}$ of the insulating layer 306, the dielectric constant $\in_{307}$ of the insulating layer 307, and the dielectric constant $\in_{308}$ of the insulating layer 308 are set to 4, 6, and 8, respectively. At this time, the dielectric constant $\in$ of the insulating layer 402 is, $\in$=5.538.

In FIG. 4C, the insulating layer 403 is an insulating layer with a five-layer stacked structure, and the dielectric constant $\in_{309}$ of the insulating layer 309, the dielectric constant $\in_{310}$ of the insulating layer 310, the dielectric constant $\in_{311}$ of the insulating layer 311, the dielectric constant $\in_{312}$ of the insulating layer 312, and the dielectric constant $\in_{313}$ of the insulating layer 313 are set to 4, 5, 6, 7, and 8, respectively. At this time, the dielectric constant $\in$ of the insulating layer 403 is, $\in$=5.653.

As described above, in an insulating layer with a multilayer stacked structure, the larger the number of layers forming the insulating layer is and the smaller the variation width of the refractive index or dielectric constant of each layer is, the more the transmittance and dielectric constant of the insulating layer improve; therefore, the light emission luminance and luminous efficiency improve.

However, the insulating layer with a multilayer stacked structure has at least one interface in the layer. As described above, since reflection of light that is emitted from a light emitting layer is generated at an interface, the existence of the interface in the layer is undesirable for improving light emission luminance and luminous efficiency. An insulating layer of the present invention has a structure in which the refractive index or dielectric constant increases monotonically in a film thickness direction; therefore, the variation width is extremely small and constant. Furthermore, unlike a multilayer stacked structure, the insulating layer of the present invention has gradations of property values of the film in a single layer; therefore, reflection of light at an interface in the layer is not generated. Accordingly, when the insulating layer of the present invention is used, a light emitting element with more improved light emission luminance and luminous efficiency than a light emitting element using an insulating layer with a multilayer stacked structure can be provided.

Embodiment Mode 2

A light emitting element and a manufacturing method of the light emitting element in this embodiment mode will be described in detail with reference to FIGS. 2A and 2B. In this embodiment mode, insulating layers are provided so as to be in contact with each of a pair of electrodes sandwiching a light emitting layer.

Figure 2A:
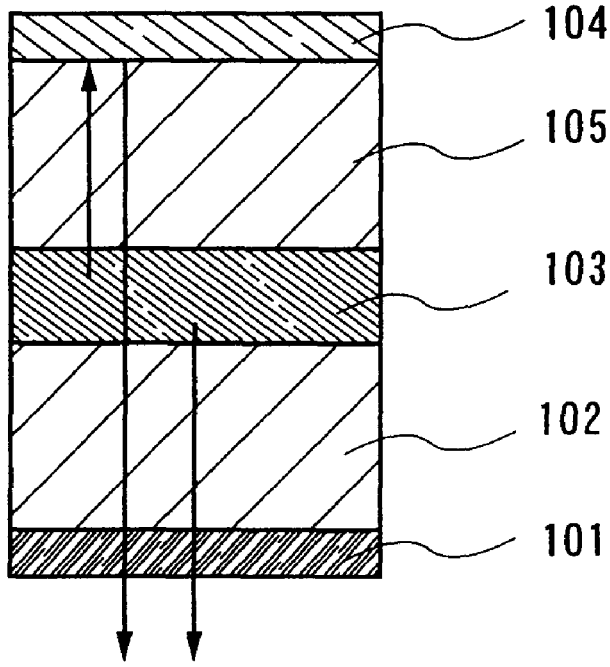
FIGS. 2A and 2B are views of light emitting elements of the present invention.

FIG. 2A shows a structure in which a second insulating layer 105 is provided between the electroluminescent layer 103 and the second electrode layer 104 of FIG. 1A.

An insulating layer 102 in FIG. 2A includes silicon nitride with a high refractive index on the electroluminescent layer 103 side and silicon oxynitride or silicon oxide with a low refractive index on a first electrode layer 101 side. Accordingly, it can be said that the insulating layer 102 is a silicon film containing oxygen and nitrogen. In this insulating layer 102, the refractive index and dielectric constant are changed continuously in a single layer without an interface. This insulating layer 102 does not have an interface, unlike the case where a film with a high refractive index and a film with a low refractive index are stacked, and the refractive index is changed continuously in a single layer. Therefore, since there is no reflection at an interface, light extraction efficiency is improved. In addition, since the insulating layer includes silicon oxynitride or silicon oxide with a low stress on the first electrode layer 101 side, peeling at an interface with the first electrode layer 101 can be prevented, and the reliability is improved.

As for the refractive index in the insulating layer 102, it is acceptable as long as the refractive index increases or decreases monotonically in a film thickness direction in accordance with the refractive index of a substance for each of the two layers provided so as to be in contact with the insulating layer 102. For example, the refractive index of the insulating layer 102 may increase monotonically from an interface on the side of a substance with a low refractive index to an interface on the side of a substance with a high refractive index, of two interfaces with substances for forming layers sandwiching the insulating layer 102.

The refractive index of the insulating layer 102 may be changed by any means or method. For example, when the insulating layer 102 contains a plurality of substances including at least a first substance and a second substance, compositions of these substances may be changed monotonically so that the refractive index is changed monotonically in the insulating layer 102.

Here, an example of forming a film in which the refractive index is changed monotonically in a film thickness direction, as the insulating layer 102, by a sputtering apparatus will be described. In this embodiment mode, a silicon film containing oxygen and nitrogen, formed of nitrogen, oxygen, and silicon, is formed as the insulating layer 102. In addition, in this embodiment mode, nitrogen and oxygen are used as the first substance and the second substance, respectively, and the refractive index in the insulating layer 102 is changed by a change in their composition ratio. It is to be noted that the insulating layer 102, the first substance, and the second substance are not limited to this embodiment mode, and a practitioner may appropriately select these, depending on the refractive indexes of the first electrode layer 101 and the electroluminescent layer 103. In this embodiment mode, a conductive metal oxide film (for example, an ITO film), is used as the first electrode layer 101.

A silicon target is used as a target of sputtering. A power supply used in sputtering may be a DC power supply or an AC power supply. As a gas for sputtering, argon, oxygen, and nitrogen are used. A silicon film containing oxygen and nitrogen is formed while gradually increasing a flow rate of nitrogen from 0 sccm to a certain flow rate (for example, 30 sccm) and gradually decreasing a flow rate of oxygen from a certain flow rate (for example, 30 sccm) to 0 sccm ultimately. By changing a ratio of silicon oxide and silicon nitride in the film to be formed, a silicon film containing oxygen and nitrogen in which composition of nitrogen and oxygen is changed monotonically is formed.

Alternatively, as a forming method of a silicon film containing oxygen and nitrogen, formed of nitrogen, oxygen, and silicon, the following may be employed. In a sputtering apparatus, two targets, which are silicon oxide and silicon nitride, are used. A power supply used in sputtering may be a DC power supply or an AC power supply. A silicon film containing oxygen and nitrogen is formed while increasing power of the power supply for the silicon nitride target from 0 W to a certain power (for example, 3 kW) ultimately and decreasing power of the power supply for the silicon oxide target from a certain power (for example, 3 kW) to 0 W ultimately. By changing a ratio of silicon oxide and silicon nitride in the film to be formed, a silicon film containing oxygen and nitrogen in which composition of nitrogen and oxygen is changed monotonically is formed.

It is preferable that silicon nitride be in contact with the electroluminescent layer 103 since silicon nitride has a high withstand voltage. Furthermore, it is preferable that silicon oxynitride or silicon oxide be in contact with the first electrode layer 101 since silicon oxynitride or silicon oxide is a film with a low stress, and that its refractive index be equal or close to that of the first electrode layer 101.

Although the above example has been described particularly by taking the refractive index as an example, silicon nitride included in the insulating layer 102 on the electroluminescent layer 103 side has a high dielectric constant and stress, and silicon oxynitride or silicon oxide included in the insulating layer 102 on the first electrode layer 101 side has a low dielectric constant and stress. Therefore, when the insulating layer 102 is formed as a silicon film containing oxygen and nitrogen in which the composition of nitrogen and oxygen is changed monotonically, the insulating layer 102 can be a film in which the refractive index, dielectric constant, and internal stress are changed continuously. Furthermore, depending on a material for constituting the insulating film, a structure in which any one of the refractive index, dielectric constant, or internal stress is changed monotonically from the electrode side toward the electroluminescent layer side may be employed. A method which is similar to the above-described method can be used when the dielectric constant or internal stress is changed continuously in an insulating layer.

In addition, the second insulating layer 105 includes silicon nitride which is dense and high in stress and withstand voltage on the electroluminescent layer 103 side and silicon oxynitride or silicon oxide which is a film with a low stress on the second electrode layer 104 side. In the second insulating layer 105, the internal stress is changed continuously in a single layer and stress is relieved, therefore, peeling can be prevented and the reliability is improved. Furthermore, since light that is emitted from the electroluminescent layer 103 to the second electrode layer 104 side passes through the insulating layer 105, is reflected by the second electrode layer 104, passes through the insulating layer 105 again, and is transmitted through the first electrode layer 101. Therefore, it is preferable that the insulating layer between the electroluminescent layer 103 and the second electrode layer 104 have no interface and the refractive index be changed continuously in a single layer, whereby light extraction efficiency is improved.

Figure 2B:
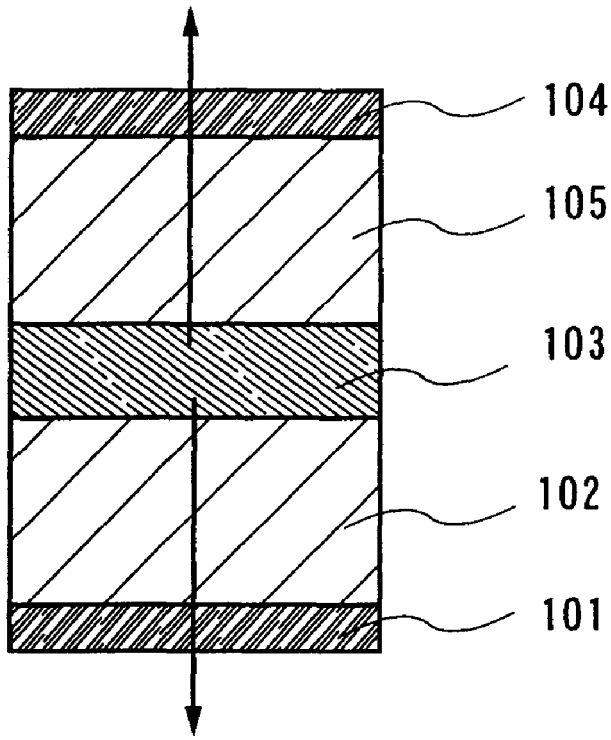

As shown in FIG. 2B, when both the first electrode layer 101 and the second electrode layer 104 are electrodes having a light-transmitting property, the element is of a dual emission type in which light is extracted from both the first electrode layer 101 side and the second electrode layer 104 side, which has a structure where the second insulating layer 105 which has no interface and in which the refractive index is changed continuously in a single layer is provided between the electroluminescent layer 103 and the second electrode layer 104 in FIG. 1B. By forming the first insulating layer 102 and the second insulating layer 105 so as to each have a structure in which the refractive index is changed continuously, light extraction efficiency on the both electrode sides is improved.

Alternatively, a structure in which the refractive index and an internal stress are changed continuously in at least one of the two insulating layers may be employed. Even in this case, the light emission luminance is improved since the refractive index and internal stress are changed continuously in one of the insulating layers; in addition, since the other insulating layer is a simple insulating layer formed of a single layer or stacked layers, the element can be manufactured simply at low costs.

Materials and manufacturing methods for the light emitting layer and the electrode layer may be similar to those in Embodiment Mode 1, and detailed description is omitted here.

As described above, light that is emitted from a light emitting layer in a light emitting element is extracted after transmitted through an insulating layer. Since an insulating layer included in a light emitting layer of the present invention does not have an interface in a layer and is a film in which the refractive index and dielectric constant are changed continuously; therefore, light extraction efficiency is high. In addition, since the internal stress is also changed continuously in the insulating layer, adhesiveness with a light emitting layer and an electrode layer to be stacked is good. Therefore, a highly reliable light emitting element with high luminous efficiency and high light emission luminance can be obtained. With such a light emitting element, a highly reliable and high-performance light emitting device can be manufactured.

Embodiment Mode 3

In this embodiment mode, an example of a dispersion-type light emitting element using the present invention will be described.

In a case of a dispersion-type inorganic EL element, a film-like electroluminescent layer is formed by dispersing particles of a light emitting material in a binder. When particles with a desired size cannot be obtained adequately by a manufacturing method of the light emitting material, the light emitting material may be processed into particles by grinding in a mortar or the like. A binder is a substance for binding particles of the light emitting material in a dispersed state and holding them in a shape as an electroluminescent layer. The light emitting material is uniformly dispersed and secured in the electroluminescent layer owing to the binder.

In a case of a dispersion-type inorganic EL element, as a method for forming an electroluminescent layer, a droplet discharging method, a printing method (such as screen printing or offset printing), which can selectively form an electroluminescent layer, a coating method such as a spin coating method, a dipping method, a dispenser method, or the like can be used. The film thickness of the electroluminescent layer is not particularly limited; however, it is preferable that the thickness be in a range of 10 nm to 1000 nm. In addition, in the electroluminescent layer containing a light emitting material and a binder, a ratio of the light emitting material is preferably set to be greater than or equal to 50 wt % and less than or equal to 80 wt %.

Figure 3:
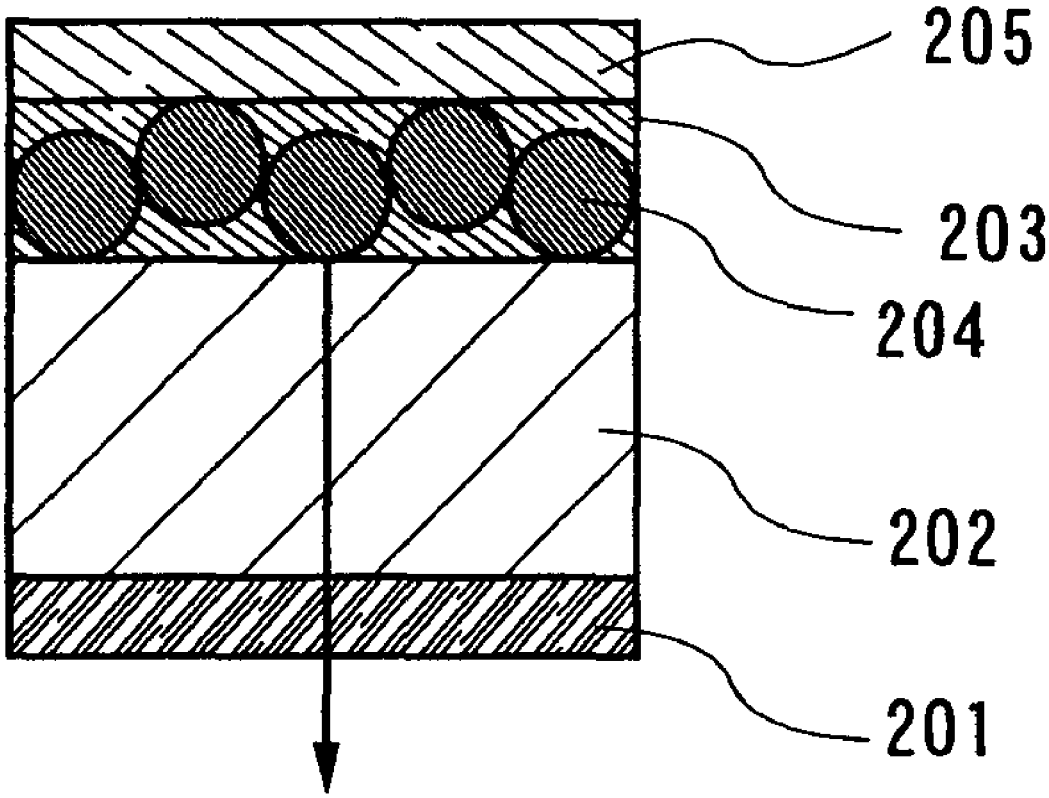
FIG. 3 is a view of a light emitting element of the present invention.

FIG. 3 shows an example of a dispersion-type inorganic EL element that can be used as a light emitting element. In FIG. 3, the light emitting element has a stacked structure including a first electrode layer 201, an insulating layer 202, an electroluminescent layer 203, and a second electrode layer 205, where a light emitting material 204 held by a binder is included in the electroluminescent layer 203. In this embodiment mode, a material similar to those described in Embodiment Mode 1 can be used as the light emitting material 204.

As the binder of the dispersion-type inorganic EL element of this embodiment mode, an insulating material can be used. In addition, an organic material or an inorganic material can be used as the binder, or a mixed material of an organic material and an inorganic material may be used. As an organic insulating material, a resin such as a cyanoethyl cellulose based resin having a comparatively high dielectric constant, polyethylene, polypropylene, a polystyrene based resin, a silicone resin, an epoxy resin, or vinylidene fluoride can be used. In addition, a heat-resistant high molecular compound such as aromatic polyamide or polybenzimidazole, or a siloxane resin may be used. A siloxane resin corresponds to a resin containing a Si—O—Si bond. Siloxane is composed of a skeleton structure formed by the bond of silicon (Si) and oxygen (O). As a substituent thereof, an organic group containing at least hydrogen (such as an alkyl group or aromatic hydrocarbon) is used. In addition, a fluoro group may be used as the substituent. Further, an organic group containing at least hydrogen and a fluoro group may be used as the substituent. Moreover, a vinyl resin such as polyvinyl alcohol or polyvinyl butyral, or a resin material such as a phenol resin, a novolac resin, an acrylic resin, a melamine resin, a urethane resin, an oxazole resin (polybenzoxazole) may also be used as the organic insulating material. The dielectric constant can also be adjusted by appropriately mixing these resins with microparticles having a high dielectric constant such as barium titanate ($BaTiO_3$) or strontium titanate ($SrTiO_3$).

As an inorganic insulating material contained in the binder, a material selected from silicon oxide ($SiO_x$), silicone nitride ($SiN_x$), silicon containing oxygen and nitrogen, aluminum nitride (AlN), aluminum containing oxygen and nitrogen or aluminum oxide ($Al_2O_3$), titanium oxide ($TiO_2$), $BaTiO_3$, $SrTiO_3$, lead titanate ($PbTiO_3$), potassium niobate ($KNbO_3$), lead niobate ($PbNbO_3$), tantalum oxide ($Ta_2O_5$), barium tantalate ($BaTa_2O_6$), lithium tantalate ($LiTaO_3$), yttrium oxide ($Y_2O_3$), zirconium oxide ($ZrO_2$), ZnS and other substances containing an inorganic insulating material can be used. By mixing an organic material with an inorganic material having a high dielectric constant (by adding or the like), the dielectric constant of an electroluminescent layer including a light emitting material and a binder can be further controlled and the dielectric constant can be further increased.

In a manufacturing process of the dispersion-type inorganic EL element of this embodiment mode, the light emitting material is dispersed in a solution containing a binder. As a solvent of the solution containing a binder that can be used in this embodiment mode, it is preferable to appropriately select such a solvent that dissolves the binder material and that can make a solution with the viscosity which is appropriate for a method for forming an electroluminescent layer (various wet processes) and a desired film thickness. When an organic solvent or the like can be used and, for example, a siloxane resin is used as the binder, propylene glycolmonomethyl ether, propylene glycolmonomethyl ether acetate (also referred to as PGMEA), 3-methoxy-3-methyl-1-butanol (also referred to as MMB), or the like can be used.

In the above-described Embodiment Modes 1 and 2, even when the electroluminescent layer is of the dispersion-type described in this embodiment mode, a similar effect can be obtained, light extraction efficiency is improved, peeling at an interface can be prevented, and the reliability is improved.

As described above, light that is emitted from a light emitting layer in a light emitting element is extracted after transmitted through an insulating layer. Since an insulating layer included in a light emitting element of the present invention does not have an interface in a layer and is a film in which the refractive index and dielectric constant are changed continuously; therefore, light extraction efficiency is high. In addition, since the internal stress is also changed continuously in the insulating layer, adhesiveness with a light emitting layer and an electrode layer to be stacked is good. Therefore, a highly reliable light emitting element with high luminous efficiency and high light emission luminance can be obtained. With such a light emitting element, a highly reliable and high-performance light emitting device can be manufactured.

Embodiment Mode 4

In this embodiment mode, an active display device in which the drive of a light emitting element is controlled by a transistor will be described.

Figure 5A:
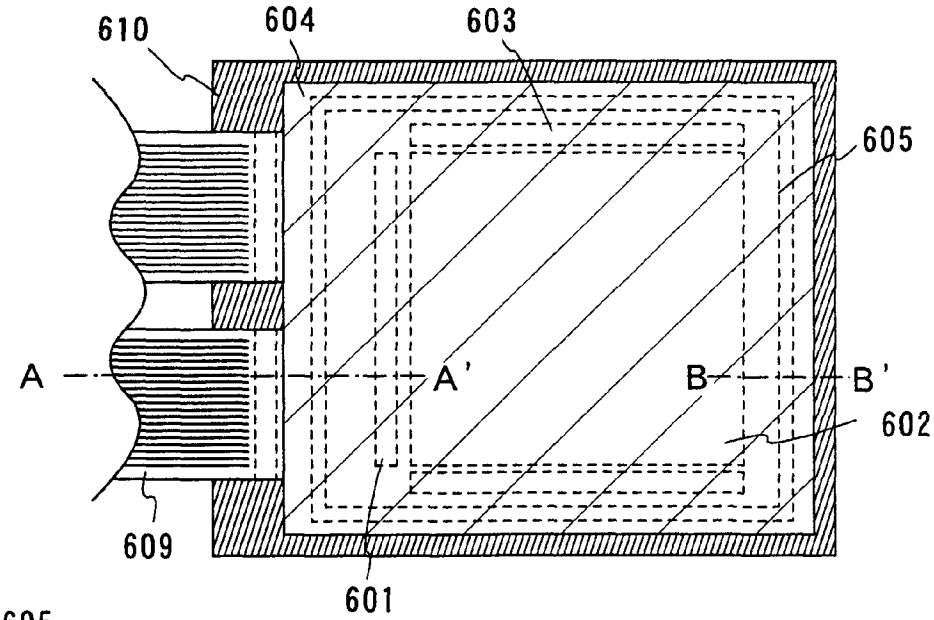
FIGS. 5A and 5B are views of a light emitting device of the present invention.
Figure 5B:
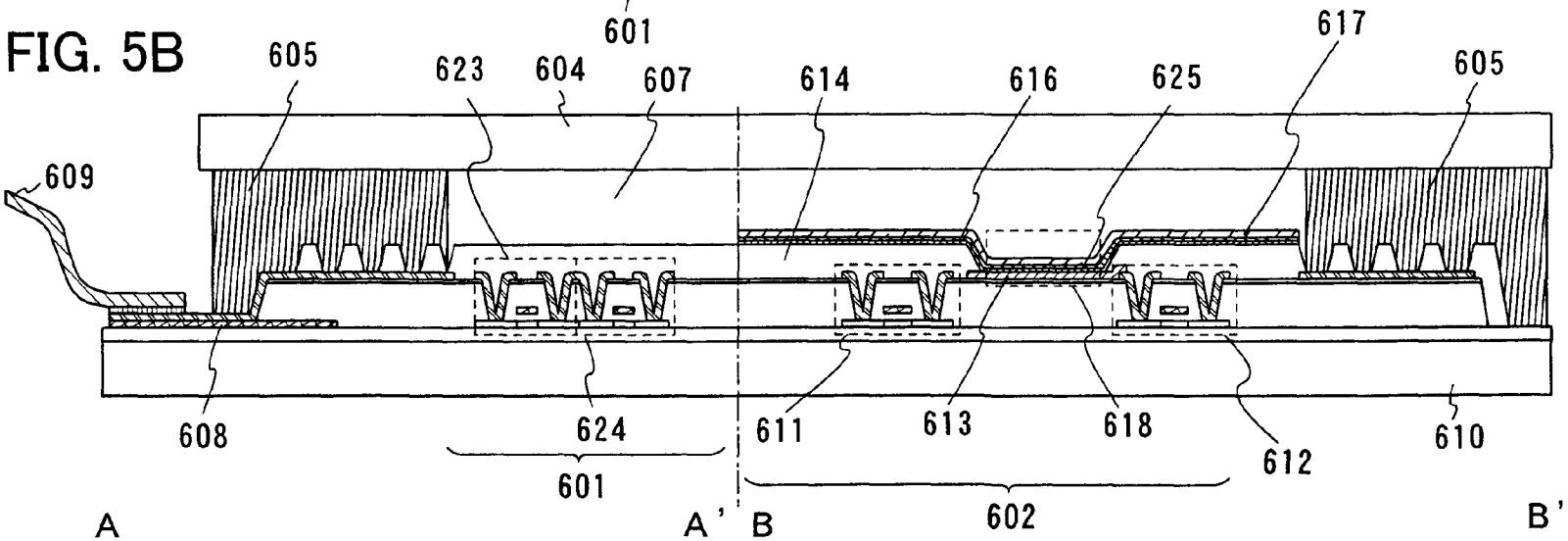

In this embodiment mode, a display device including the light emitting element manufactured by applying the present invention to a pixel portion will be described with reference to FIGS. 5A and 5B. FIG. 5A is a top view showing the display device and FIG. 5B is a cross-sectional view of FIG. 5A taken along lines A-A' and B-B'. In FIG. 5A, a reference numeral 601 denotes a driver circuit portion (a source side driver circuit); 602, a pixel portion; and 603, a driver circuit portion (a gate side driver circuit), each of which is indicated by dashed line. A reference numeral 604 denotes a sealing substrate; 605, a sealant; and a portion surrounded by the sealant 605 is a space 607.

A lead wiring 608 in FIG. 5B is a wiring for transmitting signals to be input to the source side driver circuit 601 and the gate side driver circuit 603 and receives a video signal, a clock signal, a start signal, a reset signal, and the like from an FPC (Flexible Printed Circuit) 609 that is an external input terminal. Although only the FPC is shown here, the FPC may be provided with a printed wiring board (PWB). The display device in the present specification includes not only a main body of the display device but also the display device with an FPC or a PWB attached.

Next, a cross-sectional structure will be described with reference to FIG. 5B. The driver circuit portions and the pixel portion are formed over an element substrate 610. Here, the source side driver circuit 601 that is one of the driver circuit portions and one pixel in the pixel portion 602 are shown.

A CMOS circuit that is a combination of an n-channel TFT 623 and a p-channel TFT 624 is formed as the source side driver circuit 601. The driver circuit may be a known CMOS circuit, PMOS circuit, or NMOS circuit. A driver integration type in which a driver circuit is formed over a substrate is described in this embodiment mode, but it is not necessarily required and a driver circuit can be formed not over a substrate but outside of a substrate. The structure of the TFT is not particularly limited; a staggered TFT may be employed, or an inversely staggered TFT may be employed. Crystallinity of a semiconductor film used for the TFT is not particularly limited either; an amorphous semiconductor film may be used, or a crystalline semiconductor film may be used. Furthermore, a semiconductor material is not particularly limited; an inorganic compound may be used, or an organic compound may be used.

The pixel portion 602 includes a plurality of pixels, each of which includes a switching TFT 611, a current control TFT 612, and a first electrode 613 which is electrically connected to a drain of the current control TFT 612. It is to be noted that an insulator 614 is formed to cover an end portion of the first electrode 613. Here, a positive type photosensitive acrylic resin film is used for forming the insulator 614.

The insulator 614 is formed to have a curved surface with a curvature at an upper end portion or a lower end portion thereof in order to obtain favorable coverage. For example, when positive type photosensitive acrylic is used as a material of the insulator 614, it is preferable that the insulator 614 be formed to have a curved surface with a curvature radius (0.2 μm to 3 μm) only at the upper end portion. Either a negative type which becomes insoluble in a developer by light irradiation or a positive type which becomes soluble in a developer by light irradiation can be used as the insulator 614.

An insulating layer 625, a light emitting layer 616, and a second electrode 617 are formed over the first electrode 613. Of the first electrode 613 and the second electrode 614, at least the second electrode 617 has a light-transmitting property, through which light emitted from the light emitting layer 616 can be extracted to external.

In this embodiment mode, one feature is that the refractive index, internal stress, and dielectric constant are changed continuously in the insulating layer 625 included in the light emitting element 618. Since properties of the film are changed continuously in a single layer, this insulating layer 625 has gradations of property values of the film (refractive index, internal stress, dielectric constant, and the like) in the film, and has no interface which is generated in a case of a stacked structure.

In the insulating layer 625 included in the light emitting element of the present invention, a stacked structure is not used and the refractive index is changed continuously in a single layer without an interface, whereby the refractive index of the insulating layer is controlled. Accordingly, loss in light extraction efficiency due to reflection at the interface in the insulating layer can be reduced, and light emission luminance and luminous efficiency of the light emitting element 618 are improved.

The first electrode 613, the light emitting layer 616, and the second electrode 617 can be formed by various methods. Specifically, they can be formed by a vacuum evaporation method such as a resistance heating evaporation method or an electron beam (EB) evaporation method, a physical vapor deposition (PVD) method such as a sputtering method, a chemical vapor deposition (CVD) method such as a metal organic CVD method or a low pressure hydride transport CVD method, an atomic layer epitaxy (ALE) method, or the like. Furthermore, an ink-jet method, a spin coating method, or the like can be used. In addition, each electrode or each layer may be formed by using a different film formation method. As a light emitting material contained in the light emitting layer 616, the materials and the manufacturing methods described in Embodiment Modes 1 to 3 are preferably used.

By attaching the sealing substrate 604 to the element substrate 610 with the sealant 605, the light emitting element 618 is provided in the space 607 surrounded by the element substrate 610, the sealing substrate 604, and the sealant 605. The space 607 is filled with a filler, but there is also a case where the space 607 is filled with the sealant formed of a resin or filled with an inert gas (nitrogen, argon, or the like).

An epoxy-based resin is preferably used as the sealant 605. It is desirable that materials which allow as little moisture and oxygen as possible to penetrate be used as the sealant and the filler. As the sealing substrate 604, a plastic substrate formed of FRP (Fiberglass-Reinforced Plastics), PVF (polyvinyl fluoride), a polyester film, polyester, acrylic, or the like can be used besides a glass substrate or a quartz substrate.

Light that is emitted from a light emitting layer in a light emitting element is extracted after transmitted through an insulating layer. Since an insulating layer of the present invention does not have an interface in a layer and is a film in which the refractive index and dielectric constant are changed continuously; therefore, light extraction efficiency is high. In addition, since the internal stress is also changed continuously in the insulating layer, adhesiveness with a light emitting layer and an electrode layer to be stacked is good. Therefore, a highly reliable light emitting element with high luminous efficiency and high light emission luminance can be obtained. With such a light emitting element, a highly reliable and high-performance display device can be manufactured.

Embodiment Mode 5

Figure 6A:
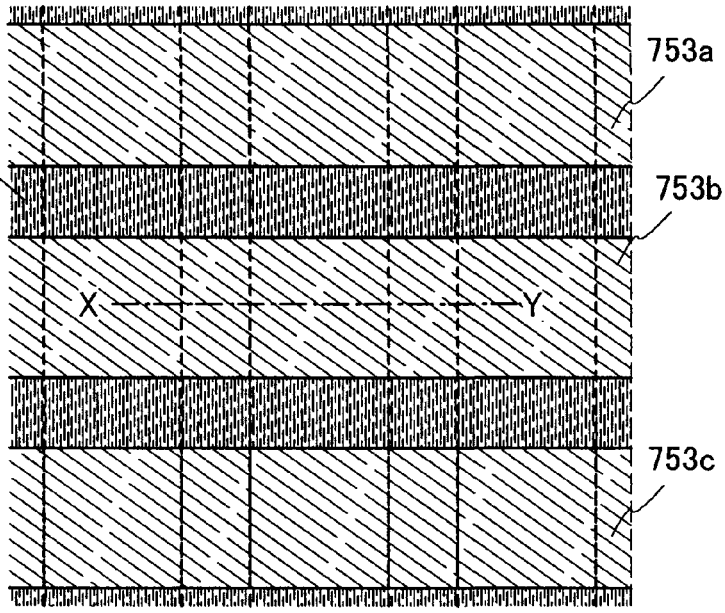
FIGS. 6A to 6C are views of light emitting devices of the present invention.
Figure 6B:
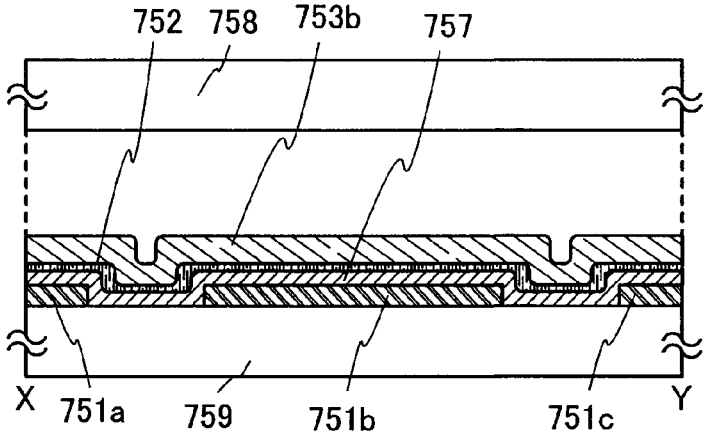
Figure 6C:
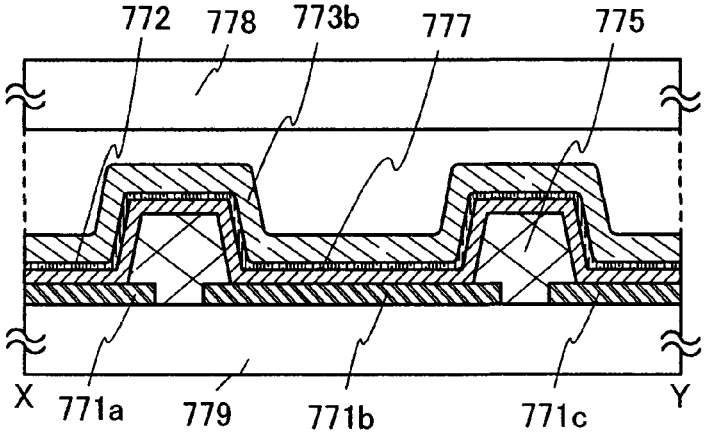

FIGS. 6A to 6C show a passive display device manufactured by applying the present invention.

FIG. 6A is a top view of a passive display device manufactured by applying the present invention, and FIG. 6B is a cross-sectional view taken along the line X-Y in FIG. 6A.

The display device, which is provided over a substrate 759, includes a first electrode layer 751*a*, a first electrode layer 751*b*, and a first electrode layer 751*c* which are extended in a first direction, an electroluminescent layer 752 which is provided so as to cover the first electrode layers 751*a*, 751*b*, and 751*c*, a second electrode layer 753*a*, a second electrode layer 753*b*, and a second electrode layer 753*c* which are extended in a second direction that is perpendicular to the first direction (see FIGS. 6A and 6B). In addition, an insulating layer 757 which has been described in Embodiment Mode 1 or 2 and the electroluminescent layer 752 are provided between the first electrode layers 751*a* to 751*c* and the second electrode layers 753*a* to 753*c*. When an influence of an electric field in a lateral direction is concerned between adjacent cells, the electroluminescent layer 752 provided in each light emitting element may be separated. The second electrode layers 753*a* to 753*c* are light-transmitting electrodes. The first electrode layers 751*a* to 751*c* may be reflective electrodes or light-transmitting electrodes.

The first electrode layers 751*a* to 751*c* each may have a tapered shape or a shape in which the curvature radius changes continuously. With such a curved surface having a curvature, the first electrode layers 751*a* to 751*c* are covered by an insulating layer and a conductive layer to be stacked thereover well.

In addition, partition walls (insulating layers) may be formed so as to cover side end portions of the first electrode layers 751*a* to 751*c*. FIG. 6C shows an example in which the side end portions of the first electrode layers in FIG. 6B are covered by the partition walls (insulating layers).

In the example of a light emitting element shown in FIG. 6C, partition walls (insulating layers) 775 are formed with tapered shapes so as to cover side end portions of a first electrode layer 771*a*, a first electrode layer 771*b*, and a first electrode layer 771*c*. The partition walls (insulating layers) 775 are formed on the first electrode layers 771*a* to 771*c* which are provided over and in contact with a substrate 779; and an insulating layer 777 which has been described in Embodiment Mode 1 or 2, an electroluminescent layer 772, and a second electrode layer 773*b* are provided thereover.

In this embodiment mode, one feature is that the refractive index, internal stress, and dielectric constant are changed continuously in the insulating layers 757 and 777 included in the light emitting element. Since properties of the film are changed continuously in a single layer, the insulating layers 757 and 777 each have gradations of property values of the film (refractive index, internal stress, dielectric constant, and the like) in the film, and has no interface which is generated in a case of a stacked structure.

In each of the insulating layers 757 and 777 of the present invention, a stacked structure is not used and the refractive index is changed continuously in a single layer without an interface, whereby the refractive index of the insulating layer is controlled. Accordingly, loss in light extraction efficiency due to reflection at the interface in the layer can be reduced, and light emission luminance and luminous efficiency of the light emitting element are improved.

As for the passive display device in FIGS. 6A to 6C, sealing substrates 758 and 778 are secured by a sealant, similarly to the active matrix display device in FIGS. 5A and 5B.

Light that is emitted from a light emitting layer in a light emitting element is extracted after transmitted through an insulating layer. As described above, since an insulating layer of the present invention does not have an interface in a layer and is a film in which the refractive index and dielectric constant are changed continuously; therefore, light extraction efficiency is high. In addition, since the internal stress is also changed continuously, adhesiveness with a light emitting layer and an electrode layer to be stacked is good. Therefore, a highly reliable light emitting element with high luminous efficiency and high light emission luminance can be obtained. With such a light emitting element, a highly reliable and high-performance display device is manufactured.

Embodiment Mode 6

A light emitting device of the present invention can be used as a display portion of an electronic device. Electronic devices described in this embodiment mode each have the light emitting element and the light emitting device which have been described in Embodiment Modes 1 to 5. Accordingly, highly reliable electronic devices with high luminous efficiency and light emission luminance can be provided.

Examples of the electronic device manufactured by applying the present invention are as follows: a video camera, a digital camera, a goggle type display, a navigation system, a sound reproducing device (a car audio system, an audio component, or the like), a computer, a game machine, a portable information terminal (a mobile computer, a cellular phone, a mobile game machine, an electronic book, or the like), an image reproducing device having a recording medium (specifically, a device for reproducing a recording medium such as a digital versatile disc (DVD) and having a display device for displaying the image), and the like. Specific examples of these electronic devices are shown in FIGS. 7A to 7D.

Figure 7A:
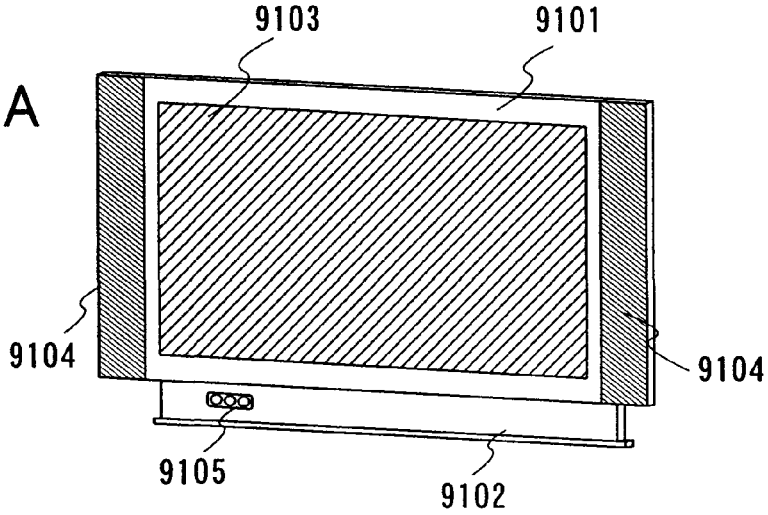
FIGS. 7A to 7D are views of electronic devices of the present invention.

FIG. 7A shows a television device according to the present invention, which includes a chassis 9101, a support base 9102, a display portion 9103, a speaker portion 9104, a video input terminal 9105, and the like. In this television device, the display portion 9103 includes light emitting elements similar to those described in Embodiment Modes 1 to 3, which are arranged in a matrix. By improving light extraction efficiency of the light emitting element, power consumption of the television device can be reduced. Accordingly, a product which is suitable for the living environment can be provided.

Figure 7B:
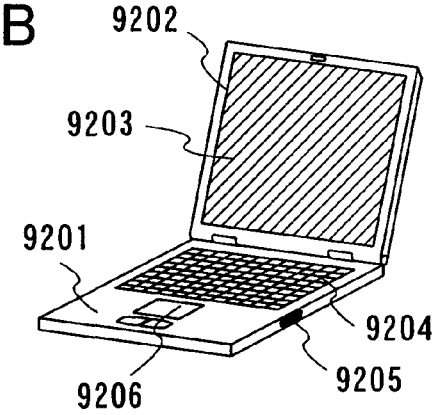

FIG. 7B shows a computer according to the present invention, which includes a main body 9201, a chassis 9202, a display portion 9203, a keyboard 9204, an external connection port 9205, a pointing device 9206, and the like. In this computer, the display portion 9203 includes the light emitting elements described in Embodiment Modes 1 to 3, which are arranged in a matrix. By improving light extraction efficiency of the light emitting element, power consumption of the computer can be reduced.

Figure 7C:
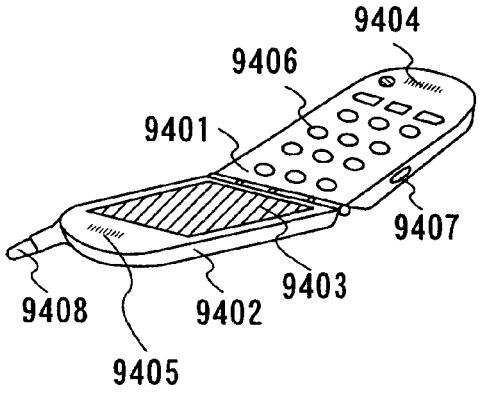

FIG. 7C shows a cellular phone according to the present invention, which includes a main body 9401, a chassis 9402, a display portion 9403, an audio input portion 9404, an audio output portion 9405, an operation key 9406, an external connection port 9407, an antenna 9408, and the like. In this cellular phone, the display portion 9403 includes the light emitting elements described in Embodiment Modes 1 to 3, which are arranged in a matrix. Since light extraction efficiency of the light emitting element is improved, power consumption of the cellular phone is reduced and the convenience thereof is further enhanced.

Figure 7D:
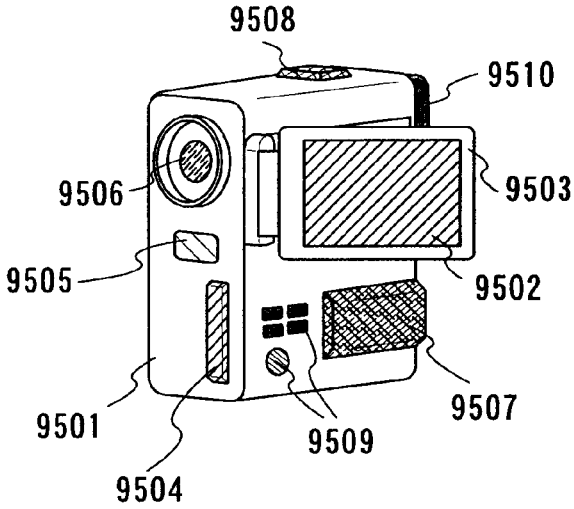

FIG. 7D shows a camera according to the present invention, which includes a main body 9501, a display portion 9502, a chassis 9503, an external connection port 9504, a remote control receiving portion 9505, an image receiving portion 9506, a battery 9507, an audio input portion 9508, operation keys 9509, an eye piece portion 9510, and the like. In this camera, the display portion 9502 includes the light emitting elements described in Embodiment Modes 1 to 3, which are arranged in a matrix. Since light extraction efficiency of the light emitting element is improved, power consumption of the camera is reduced and the convenience thereof is further enhanced.

As described above, the applicable range of the light emitting device of the present invention is so wide that the light emitting device can be applied to electronic devices of various fields. By applying the present invention, an electronic device with reduced power consumption can be manufactured.

Embodiment Mode 7

A light emitting device of the present invention can also be used as a lighting system. One mode of using the light emitting element to which the present invention is applied as a lighting system will be described with reference to FIG. 8.

Figure 8:
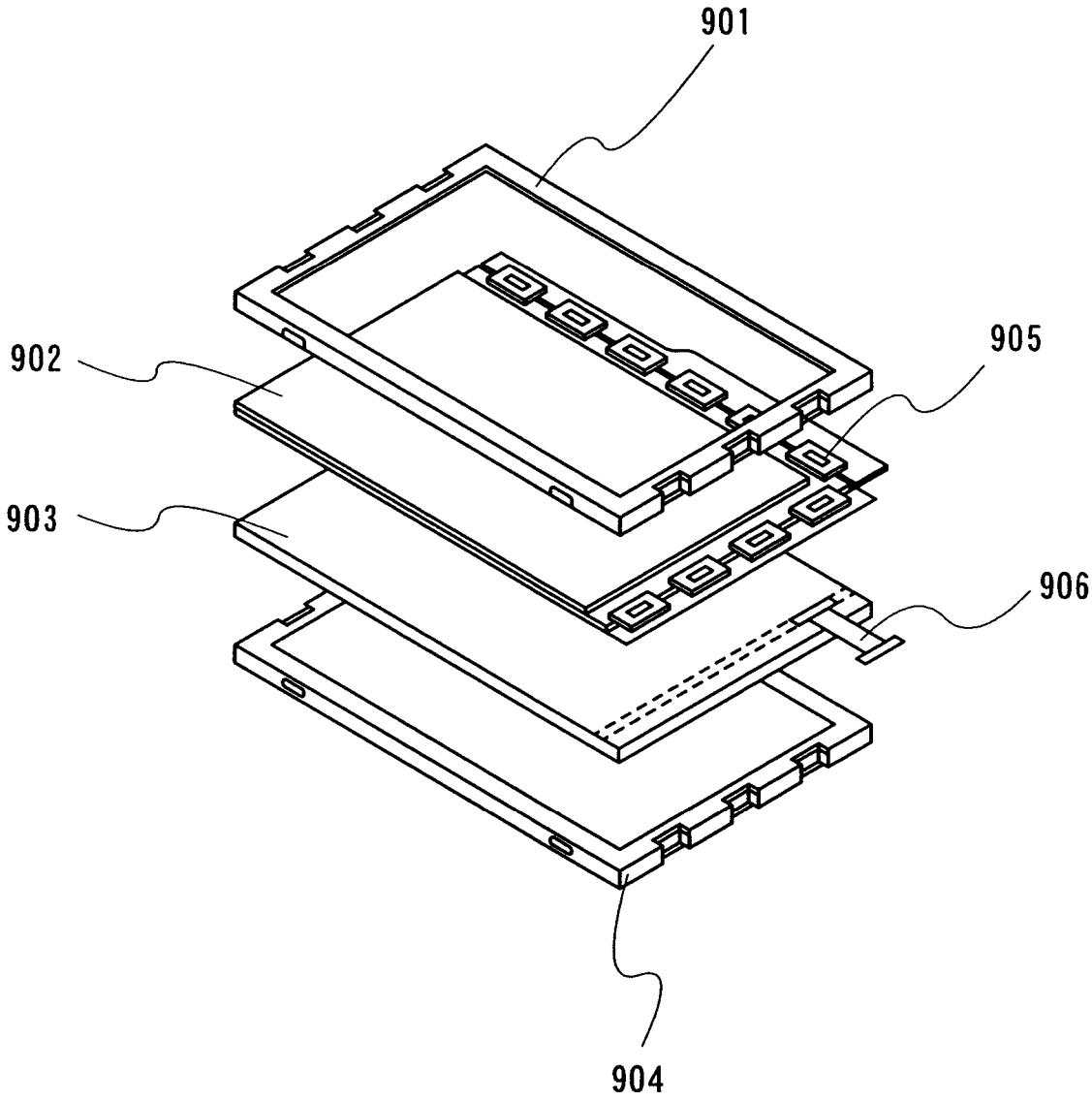
FIG. 8 is a view of an electronic device of the present invention.

FIG. 8 shows an example of a liquid crystal display device using the light emitting device to which the present invention is applied as a backlight. The liquid crystal display device shown in FIG. 8 includes a chassis 901, a liquid crystal layer 902, a backlight 903, and a chassis 904. The liquid crystal layer 902 is connected to a driver IC 905. The light emitting device of the present invention is used for the backlight 903, to which a current is supplied through a terminal 906.

By using the light emitting device to which the present invention is applied as a backlight of a liquid crystal display device, a backlight with high luminance and low power consumption can be obtained. Since the light emitting device to which the present invention is applied is a plane-emission lighting system and can be formed to have a large area, an increase in the area of a backlight can be achieved and an increase in the area of a liquid crystal display device can also be achieved. Furthermore, the light emitting device is thin and consumes low power; therefore, reductions in thickness and power consumption of the display device can also be achieved.

Needless to say, the light emitting device of the present invention can be used as a planar lighting system other than a backlight of a liquid crystal display device.

Figure 9A:
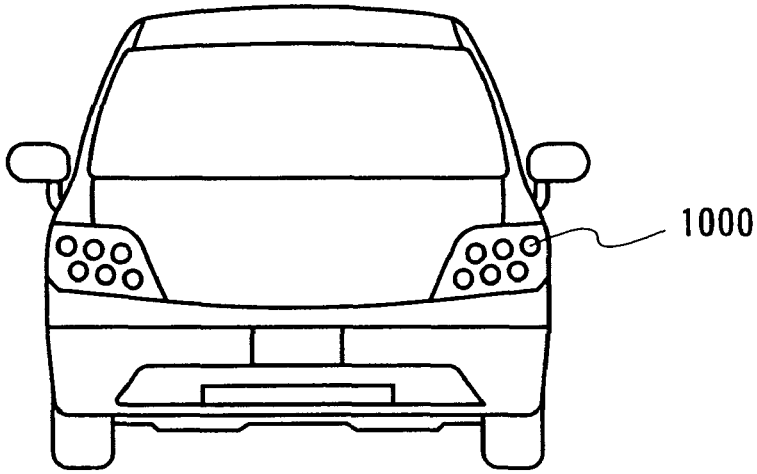
FIGS. 9A to 9C are views of a lighting apparatus of the present invention.
Figure 9B:
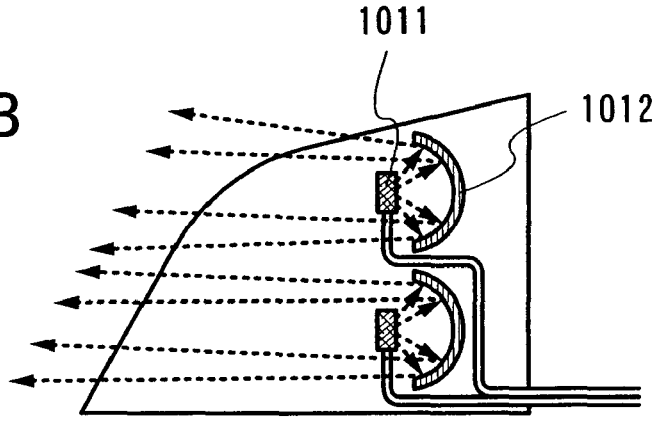
Figure 9C:
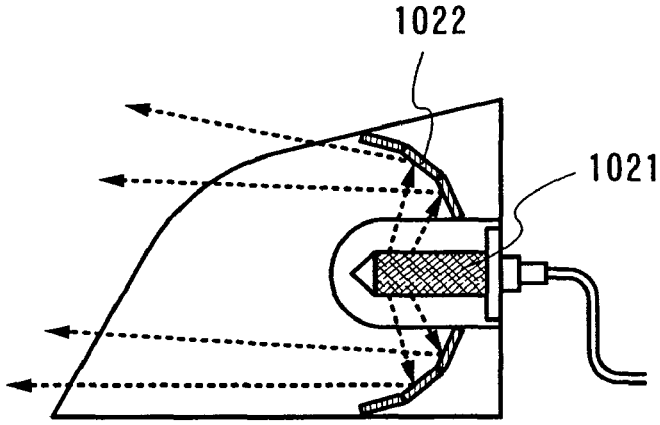

Furthermore, the light emitting device to which the present invention is applied can be used as a headlight of a car, bicycle, ship, or the like. FIGS. 9A to 9C show an example in which a light emitting device to which the present invention is applied is used as a headlight of a car. FIG. 9B is an enlarged cross-sectional view showing a headlight 1000 of FIG. 9A. In FIG. 9B, the light emitting device of the present invention is used as a light source 1011. Light emitted from the light source 1011 is reflected by a reflector 1012 and extracted to external. As shown in FIG. 9B, light with higher luminance can be obtained by using a plurality of light sources. FIG. 9C shows an example in which a light emitting device of the present invention that is manufactured in a cylindrical shape is used as a light source. Light emitted from the light source 1021 is reflected by a reflector 1022 and extracted to external.

Figure 10:
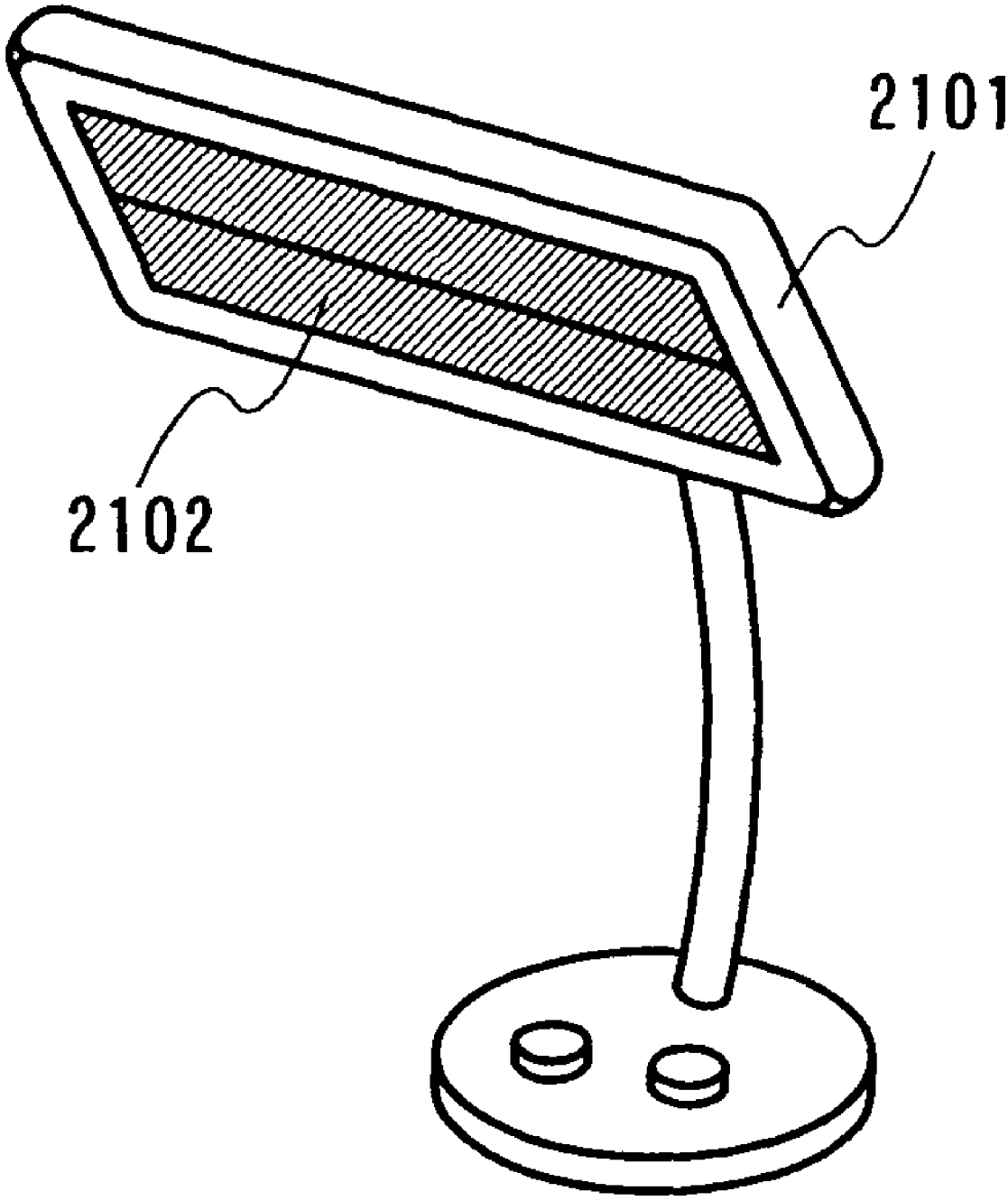
FIG. 10 is a view of a lighting apparatus of the present invention.

FIG. 10 shows an example in which a light emitting device to which the present invention is applied is used as a desk lamp that is one of lighting systems. The desk lamp shown in FIG. 10 includes a chassis 2101 and a light source 2102, and the light emitting device of the present invention is used as the light source 2102. Since the light emitting device of the present invention is capable of emitting light with high luminance, this desk lamp can illuminate hands when fine handwork is needed or the like.

Figure 11:
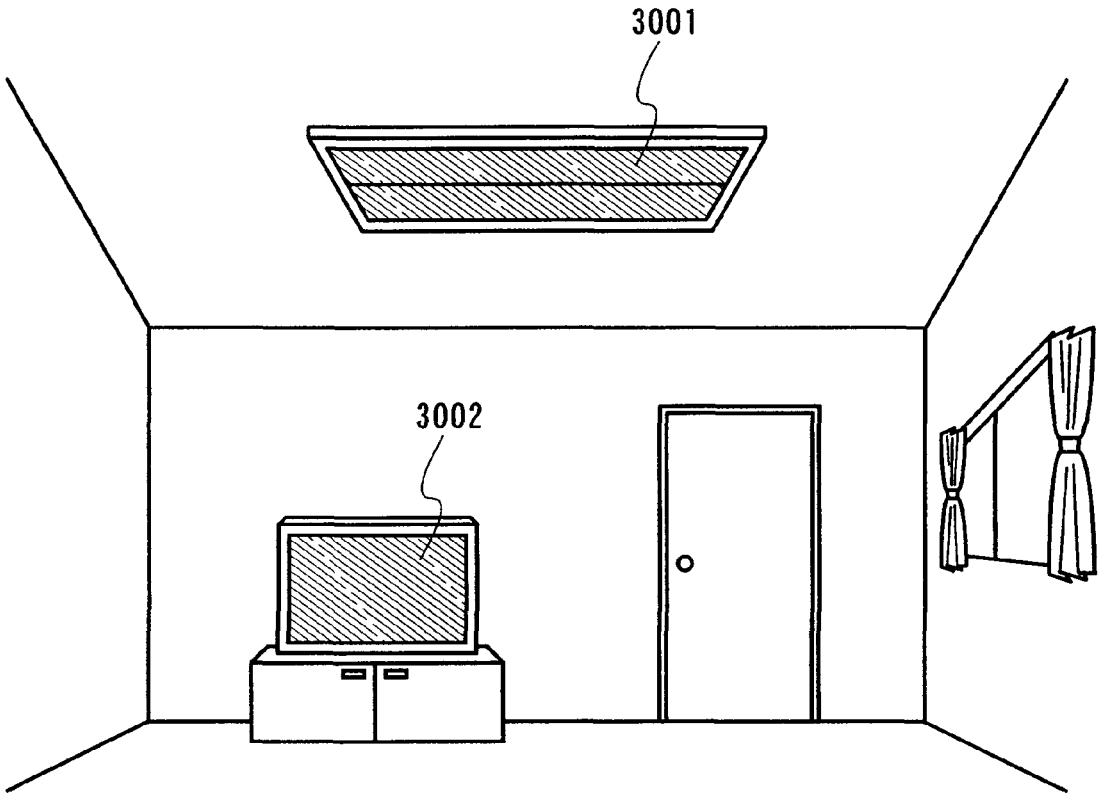
FIG. 11 is a view of a lighting apparatus of the present invention.

FIG. 11 shows an example in which a light emitting device to which the present invention is applied is used as an interior lighting system 3001. Since the light emitting device of the present invention can have a large area, it can be used as a large-area lighting system. In addition, since the light emitting device of the present invention is thin and consumes low power, it can be used as a thin lighting system with low power consumption. As shown in the drawing, a television device of the present invention as described in FIG. 7A may be set in a room where the light emitting device to which the present invention is applied is used as the indoor lighting system 3001, and public broadcasting or movies can be appreciated there. In such a case, powerful images in a bright room can be appreciated at low electricity costs, because both the lighting system and the television device consume low power.

The lighting systems are not limited to those exemplified in FIGS. 9A to 9C, 10, and 11, and the light emitting device of the present invention can be applied to lighting systems in various modes, including lighting systems for houses and public facilities. The light emitting medium of the lighting system of the present invention is a thin film, which increases design freedom. Accordingly, various elaborately-designed products can be provided to the marketplace.

As described above, due to the light emitting device of the present invention, an electronic device with reduced power consumption, high image quality, and high reliability can be provided. This embodiment mode can be freely combined with any of the above-described embodiment modes.

This application is based on Japanese Patent Application serial No. 2006-155387 filed in Japan Patent Office on Jun. 2, 2006, the entire contents of which are hereby incorporated by reference.

What is claimed is:

1. A light emitting element comprising:

a first electrode layer;

a first insulating layer comprising silicon, oxygen and nitrogen, over the first electrode layer;

an electroluminescent layer comprising an inorganic compound in contact with the first insulating layer;

a second insulating layer comprising silicon, oxygen and nitrogen over the electroluminescent layer; and a second electrode layer over the second insulating layer, wherein a concentration of oxygen contained in the first insulating layer decreases from the first electrode layer side toward the electroluminescent layer side, and a concentration of nitrogen contained in the first insulating layer increases from the first electrode layer side toward the electroluminescent layer side, and wherein a concentration of oxygen contained in the second insulating layer decreases from the second electrode layer side toward the electroluminescent layer side, and a concentration of nitrogen contained in the second insulating layer increases from the second electrode layer side toward the electroluminescent layer side.

2. A light emitting element according to claim 1, wherein the first insulating layer is in contact with the first electrode layer.

3. A light emitting element according to claim 1, wherein a refractive index of the first insulating layer increases from the first electrode layer side toward the electroluminescent layer side.

4. A light emitting element according to claim 1, wherein a dielectric constant of the first insulating layer increases from the first electrode layer side toward the electroluminescent layer side.

5. A light emitting element according to claim 1, wherein an internal stress of the first insulating layer increases from the first electrode layer side toward the electroluminescent layer side.

6. A light emitting element according to claim 1, wherein the second insulating layer is in contact with the second electrode layer and the electroluminescent layer.

7. A light emitting element according to claim 1, wherein a refractive index of the second insulating layer increases from the second electrode layer side toward the electroluminescent layer side.

8. A light emitting element according to claim 1, wherein a dielectric constant of the second insulating layer increases from the second electrode layer side toward the electroluminescent layer side.

9. A light emitting element according to claim 1, wherein an internal stress of the second insulating layer increases from the second electrode layer side toward the electroluminescent layer side.

10. A light emitting element according to claim 1, wherein the first insulating layer is a single layer.

11. A light emitting element comprising:

a first electrode layer;

a first insulating layer over the first electrode layer;

an electroluminescent layer comprising an inorganic compound in contact with the first insulating layer;

a second insulating layer over the electroluminescent layer; and a second electrode layer over the second insulating layer, wherein a refractive index of the first insulating layer increases from the first electrode layer side toward the electroluminescent layer side, and wherein a refractive index of the second insulating layer increases from the second electrode layer side toward the electroluminescent layer side.

12. A light emitting element according to claim 11, wherein the first insulating layer is in contact with the first electrode layer.

13. A light emitting element according to claim 11, wherein a dielectric constant of the first insulating layer increases from the first electrode layer side toward the electroluminescent layer side.

14. A light emitting element according to claim 11, wherein an internal stress of the first insulating layer increases from the first electrode layer side toward the electroluminescent layer side.

15. A light emitting element according to claim 11, wherein the second insulating layer is in contact with the second electrode layer and the electroluminescent layer.

16. A light emitting element according to claim 11, wherein a dielectric constant of the second insulating layer increases from the second electrode layer side toward the electroluminescent layer side.

17. A light emitting element according to claim 11, wherein an internal stress of the second insulating layer increases from the second electrode layer side toward the electroluminescent layer side.

18. A light emitting element according to claim 11, wherein the first insulating layer is a single layer.

* * * * *